US011670257B2

(12) United States Patent
Jiao et al.

(10) Patent No.: US 11,670,257 B2
(45) Date of Patent: Jun. 6, 2023

(54) METHOD AND DEVICE FOR DETERMINING OUTPUT GRAY-SCALE VALUE OF DISPLAY PANEL

(71) Applicants: Analogix (China) Semiconductor,Inc., Beijing (CN); Analogix International LLC, Wilmington, DE (US)

(72) Inventors: Xin Jiao, Beijing (CN); Ning Zhu, Beijing (CN); Xiaowei Sun, Beijing (CN)

(73) Assignees: ANALOGIX (CHINA) SEMICONDUCTOR, INC., Beijing (CN); ANALOGIX INTERNATIONAL LLC, Wilmington, DE (US)

( * ) Notice: Subject to any disclaimer, the term of this patent is extended or adjusted under 35 U.S.C. 154(b) by 17 days.

(21) Appl. No.: 16/965,359

(22) PCT Filed: Oct. 23, 2018

(86) PCT No.: PCT/CN2018/111441
§ 371 (c)(1),
(2) Date: Jul. 28, 2020

(87) PCT Pub. No.: WO2019/205527
PCT Pub. Date: Oct. 31, 2019

(65) Prior Publication Data

US 2021/0151005 A1 May 20, 2021

(30) Foreign Application Priority Data

Apr. 24, 2018 (CN) ..... 201810374108.5

(51) Int. Cl.
*G09G 5/10* (2006.01)

(52) U.S. Cl.
CPC ..... *G09G 5/10* (2013.01); *G09G 2320/0233* (2013.01); *G09G 2320/0271* (2013.01); *G09G 2360/16* (2013.01)

(58) Field of Classification Search
None
See application file for complete search history.

(56) References Cited

U.S. PATENT DOCUMENTS

2015/0332444 A1 11/2015 Tsuda
2018/0204529 A1* 7/2018 Chen ..... G09G 3/006
(Continued)

FOREIGN PATENT DOCUMENTS

CN 103680449 A 3/2014
CN 104021759 A 9/2014
(Continued)

OTHER PUBLICATIONS

International Search Report for corresponding application PCT/CN2018/111441 filed Oct. 23, 2018; dated Jan. 29, 2019.

*Primary Examiner* — Amr A Awad
*Assistant Examiner* — Donna V Bocar
(74) *Attorney, Agent, or Firm* — Cantor Colburn LLP

(57) ABSTRACT

Disclosed are a method and device for determining a gray-scale value of a display panel. The method includes that: brightness values corresponding to multiple gray scales under a target area of a display panel are fitted to obtain a target slope value and a target deviation value; a reference brightness value under a target gray scale of the display panel is determined according to the target slope value and the target deviation value; and an output gray-scale value corresponding to each pixel under the target gray scale is determined according to the reference brightness value.

18 Claims, 2 Drawing Sheets

(56) References Cited

U.S. PATENT DOCUMENTS

| | | | | |
|---|---|---|---|---|
| 2019/0237014 | A1* | 8/2019 | Leerentveld | G09G 3/3233 |
| 2019/0385544 | A1* | 12/2019 | Tan | G09G 3/3607 |
| 2021/0166654 | A1* | 6/2021 | Yu | G09G 3/2007 |

FOREIGN PATENT DOCUMENTS

| | | | |
|---|---|---|---|
| CN | 104409066 | A | 3/2015 |
| CN | 105529002 | A | 4/2016 |
| CN | 105575326 | A | 5/2016 |
| CN | 106023916 | A | 10/2016 |
| CN | 106097654 | A | 11/2016 |
| CN | 106531050 | A | 3/2017 |
| CN | 106601167 | A | 4/2017 |
| CN | 107799084 | A | 3/2018 |
| CN | 107863086 | A | 3/2018 |
| KR | 1020150078850 | A | 7/2015 |

* cited by examiner

METHOD AND DEVICE FOR DETERMINING OUTPUT GRAY-SCALE VALUE OF DISPLAY PANEL

TECHNICAL FIELD

The present disclosure relates to the field of display technology, in particular to a method and device for determining an output gray-scale value of a display panel.

BACKGROUND

In a related art, Mura is a phenomenon of a variety of traces caused by nonuniform in-plane brightness of a display, and Demura is a technology that eliminates Mura of the display to make screen brightness uniform. The basic principles of the Demura technology are making a panel display a gray-scale image, using a charge coupled device to capture a screen, obtaining a brightness value of each pixel in the panel, and then adjusting the gray-scale value or voltage of the pixel in a Mura area. At present, when the gray-scale value or voltage of each pixel is determined, the corresponding gray-scale value is often calculated according to a gamma value of a display (a specific value indicating the distortion of an output image of the display to an input signal) and a target brightness value, but this way needs to obtain an actual brightness value and the current brightness value to determine the gamma value through a complex formula, for example, $$\text{Gamma} = \frac{\log\left(\frac{L_i}{L_{255}}\right)}{\log\left(\frac{Gray_i}{255}\right)},$$

where $L_1$ indicates the brightness value under the gray scale i, $L_{225}$ indicates the brightness value of a sub-pixel under the gray scale 255 (namely the maximum gray scale), and $Gray_i$ indicates the gray-scale value under the gray scale i; and according to the above formula, the specific value of distortion is determined. The efficiency of calculation of this way is low, and due to the complexity of the existing Mura correction technology and the large amount of compensation data, there is a great impact on the cost of the display, which also causes greater storage pressure of a memory.

For the technical problem of low efficiency caused by a large amount of calculation when a gray-scale value of a display panel is calculated, an effective solution has not been presented yet.

SUMMARY

According to an aspect of the embodiments of the present disclosure, a method for determining an output gray-scale value of a display panel is provided, which includes that: brightness values corresponding to multiple gray scales under a target area of the display panel are fitted to obtain a target slope value and a target deviation value; a reference brightness value corresponding to a target pixel of the display panel is determined according to the target slope value and the target deviation value. An output gray-scale value corresponding to each pixel under the target gray scale is determined according to the reference brightness value.

In some embodiments of the present disclosure, the operation that the brightness values corresponding to the multiple gray scales under the target area of the display panel are fitted to obtain the target slope value and the target deviation value includes that: the brightness value corresponding to each pixel under the multiple gray scales is acquired to obtain multiple brightness values corresponding to each gray scale; multiple accumulated brightness values are obtained according to the multiple brightness values corresponding to each gray scale; the average brightness value corresponding to each gray scale is determined according to the multiple accumulated brightness values; and the target slope value and the target deviation value are determined according to the average brightness value corresponding to each gray scale.

In some embodiments of the present disclosure, the operation that the target slope value and the target deviation value are determined according to the average brightness value corresponding to each gray scale includes that: the multiple gray scales and the average brightness value under each gray scale are fitted to determine a target reference line; and the target slope value and the target deviation value are determined according to the target reference line.

In some embodiments of the present disclosure, the multiple gray scales at least include: the target gray scale and a maximum gray scale. Before the reference brightness value under the target gray scale of the display panel is determined according to the target slope value and the target deviation value, the method further includes that: the average brightness value corresponding to the maximum gray scale in the multiple gray scales is acquired; according to the average brightness value corresponding to the maximum gray scale, the average brightness value corresponding to the maximum gray scale and each pixel are fitted to determine a slope value and a deviation value corresponding to each pixel; and according to the slope value and the deviation value corresponding to each pixel, gamma of each pixel in the display panel is determined.

In some embodiments of the present disclosure, the operation that the average brightness value corresponding to the maximum gray scale and each pixel are fitted to determine the slope value and the deviation value corresponding to each pixel includes that: each of the multiple gray scales and the maximum gray scale are normalized to obtain multiple normalized gray-scale values; the multiple brightness values of each pixel and the average brightness value corresponding to the maximum gray scale are normalized to obtain multiple normalized brightness values; and the slope value and the deviation value corresponding to each pixel are determined according to the multiple normalized gray-scale values and the multiple normalized brightness values.

In some embodiments of the present disclosure, the operation that the reference brightness value under the target gray scale of the display panel is determined according to the target slope value and the target deviation value includes that: a target gray-scale value corresponding to the target gray scale is determined; a gray-scale ratio is determined according to the target gray-scale value corresponding to the target gray scale and a maximum gray-scale value corresponding to the maximum gray scale; and the reference brightness value under the target gray scale of the display panel is determined according to the normalized gray-scale value and a first formula, wherein the first formula is: f(ref)=aX+b, where x=log(GRAY/255), GRAY is the target gray-scale value, a is the target slope value, b is the target deviation value, f(ref) is the reference brightness value, and X is the normalized gray-scale value.

In some embodiments of the present disclosure, the operation that the output gray-scale value corresponding to each pixel under the target gray scale is determined according to the reference brightness value includes that: the output gray-scale value corresponding to each pixel under the target gray scale is calculated through the reference brightness value and a second formula, wherein the second formula is: log(Li/L255)=a*log(Grayi/255)+b, where a is the slope value of a target pixel, b is the deviation value of the target pixel, i is the target gray scale, Li is the reference brightness value under the target gray scale, L255 is the average brightness value corresponding to the maximum gray scale, and Grayi is the output gray-scale value corresponding to the target pixel under the target gray scale.

In some embodiments of the present disclosure, the multiple gray scales at least include the target gray scale and the maximum gray scale. The operation that the output gray-scale value corresponding to each pixel under the target gray scale according to the reference brightness value further includes that: the target gray scale and the maximum gray scale are normalized through the reference brightness value, and a preset normalized gray scale table is queried to obtain a target normalized gray-scale value; the multiple normalized gray-scale values corresponding to the multiple adjacent gray scales of the target gray scale are queried in the preset normalized gray scale table; and the multiple normalized brightness values corresponding to the multiple gray scales are calculated through the target normalized gray-scale value, the multiple normalized gray-scale values and a third formula, wherein the third formula is: log(L/L255)=a*log(Gray/255)+b, where a is the target slope value, b is the target deviation value, log(Gray/255) is the normalized gray-scale value, and log(L/L255) is the normalized brightness value; the difference between each of the multiple normalized brightness values and the reference brightness value is acquired to obtain multiple brightness difference values; the brightness value corresponding to a minimum absolute value in the brightness difference values is queried to obtain a target brightness value; and the output gray-scale value corresponding to the target brightness value is determined.

In some embodiments of the present disclosure, after the output gray-scale value corresponding to each pixel under the target gray scale is determined according to the reference brightness value, the method further includes that: according to the distribution of pixels of the display panel, the slope values and the deviation values corresponding to the multiple pixels under each gray scale are partitioned, and a data area with a preset width and a preset length is determined, wherein the data area includes multiple data blocks, and the gray-scale values are stored in each data block; data in the data block at a target position in the data area is determined as reference data; an index difference value between every two adjacent data blocks is determined according to a preset index mode; index values corresponding to other data blocks except the data block at the target position are determined according to the index difference value.

In some embodiments of the present disclosure, after the index values corresponding to other data blocks except the data block at the target position are determined, the method further includes that the reference data corresponding to the data block at the target position in the data area and the index values corresponding to other data blocks except the data block at the target position are stored respectively.

According to another aspect of the embodiments of the present disclosure, a device for determining an output gray-scale value of a display panel is provided, which includes a fitting component, configured to fit brightness values corresponding to multiple gray scales under a target area of the display panel to obtain a target slope value and a target deviation value; a first determining component, configured to determine, according to the target slope value and the target deviation value, a reference brightness value corresponding to a target pixel of the display panel; and a second determining component, configured to determine, according to the reference brightness value, an output gray-scale value corresponding to each pixel under the target gray scale.

In some embodiments of the present disclosure, the fitting component includes: a first acquiring element, configured to acquire the brightness value corresponding to each pixel under the multiple gray scales to obtain multiple brightness values corresponding to each gray scale; an accumulating element, configured to obtain multiple accumulated brightness values according to the multiple brightness values corresponding to each gray scale; a first determining element, configured to determine the average brightness value corresponding to each gray scale according to the multiple accumulated brightness values; and a second determining element, configured to determine the target slope value and the target deviation value according to the average brightness value corresponding to each gray scale.

In some embodiments of the present disclosure, the second determining element may include: a first determining subelement, configured to fit the multiple gray scales and the average brightness value under each gray scale to determine a target reference line; and a second determining subelement, configured to determine the target slope value and the target deviation value according to the target reference line.

In some embodiments of the present disclosure, the multiple gray scales at least include: the target gray scale and the maximum gray scale. The device further includes: a second acquiring element, configured to acquire, before determining the reference brightness value under the target gray scale of the display panel according to the target slope value and the target deviation value, an average brightness value corresponding to the maximum gray scale in the multiple gray scales; a fitting element, configured to fit, according to the average brightness value corresponding to the maximum gray scale, the average brightness value corresponding to the maximum gray scale and each pixel to determine a slope value and a deviation value corresponding to each pixel; and a third determining element, configured to determine, according to the slope value and the deviation value corresponding to each pixel, gamma of each pixel in the display panel.

In some embodiments of the present disclosure, the fitting element includes: a first normalizing element, configured to normalize each of the multiple gray scales and the maximum gray scale to obtain multiple normalized gray-scale values; a second normalizing element, configured to normalize the multiple brightness values of each pixel and the average brightness value corresponding to the maximum gray scale to obtain multiple normalized brightness values; and a fourth determining element, configured to determine the slope value and the deviation value corresponding to each pixel according to the multiple normalized gray-scale values and the multiple normalized brightness values.

In some embodiments of the present disclosure, the first determining component includes: a first determining subelement, configured to determine a target gray-scale value corresponding to the target gray scale; a second determining subelement, configured to determine a gray-scale ratio according to the target gray-scale value corresponding to the target gray scale and a maximum gray-scale value corresponding to the maximum gray scale, and determine the reference brightness value under the target gray scale of the display panel according to the normalized gray-scale value and a first formula, wherein the first formula is: f(ref)=aX+b, where x=log(GRAY/255) GRAY is the target gray-scale value, a is the target slope value, b is the target deviation value, and f(ref) is the reference brightness value.

In some embodiments of the present disclosure, the second determining component includes: a calculating element, configured to calculate the output gray-scale value corresponding to each pixel under the target gray scale through the reference brightness value and a second formula, wherein the second formula is: log(Li/L255)=a*log(Grayi/255)+b, where a is the slope value of the target pixel under the target gray scale, b is the deviation value of the target pixel under the target gray scale, i is the target gray scale, Li is the reference brightness value under the target gray scale, L255 is the average brightness value corresponding to the maximum gray scale, and Grayi is the output gray-scale value corresponding to the target pixel under the target gray scale.

In some embodiments of the present disclosure, the multiple gray scales at least include the target gray scale and the maximum gray scale. The second determining component further includes: a third normalizing element, configured to normalize the target gray scale and the maximum gray scale through the reference brightness value, and query a preset normalized gray scale table to obtain a target normalized gray-scale value; a first querying element, configured to query the multiple normalized gray-scale values corresponding to the multiple adjacent gray scales of the target gray scale in the preset normalized gray scale table; and a calculating subelement, configured to calculate the multiple normalized brightness values corresponding to the multiple gray scales through the target normalized gray-scale value, the multiple normalized gray-scale values and a third formula, wherein the third formula is: log(L/L255)=a*log(Gray/255)+b, where a is the target slope value, b is the target deviation value, log(Gray/255) is the normalized gray-scale value, and log(L/L255) is the normalized brightness value; a comparing element, configured to acquire the difference between each of the multiple normalized brightness values and the reference brightness value to obtain multiple brightness difference values; a second querying element, configured to query the brightness value corresponding to a minimum absolute value in the brightness difference values to obtain a target brightness value; and a fifth determining element, configured to determine the output gray-scale value corresponding to the target brightness value.

In some embodiments of the present disclosure, the device further includes: a third determining component, configured to partition, after determining the output gray-scale value corresponding to each pixel under the target gray scale according to the reference brightness value, the slope values and the deviation values corresponding to the multiple pixels under each gray scale according to the distribution of pixels of the display panel, and determine a data area with a preset width and a preset length, wherein the data area includes multiple data blocks, and the gray-scale values are stored in each data block; a fourth determining component, configured to determine data in the data block at a target position in the data area as reference data; a fifth determining component, configured to determine an index difference value between every two adjacent data blocks according to a preset index mode; and a sixth determining component, configured to determine index values corresponding to other data blocks except the data block at the target position according to the index difference value.

In some embodiments of the present disclosure, the device further includes: a storing component, configured to respectively store, after determining the index values corresponding to other data blocks except the data block at the target position, the reference data corresponding to the data block at the target position in the data area and the index values corresponding to other data blocks except the data block at the target position.

According to another aspect of the embodiments of the present disclosure, a computer readable storage medium is also provided, which is configured to store a program. When executed by a processor, the program controls a device where the computer readable storage medium is to execute the above method for determining an output gray-scale value of a display panel.

According to another aspect of the embodiments of the present disclosure, a processor is also provided, which is configured to run a program. When running, the program executes the above method for determining an output gray-scale value of a display panel.

BRIEF DESCRIPTION OF THE DRAWINGS

The accompanying drawings described here are used for providing further understanding of the present disclosure, and constitute a part of the present disclosure. Schematic embodiments of the present disclosure and description thereof are used for illustrating the present disclosure and not intended to form an improper limit to the present disclosure. In the accompanying drawings.

DETAILED DESCRIPTION OF THE EMBODIMENTS

Figure 1:
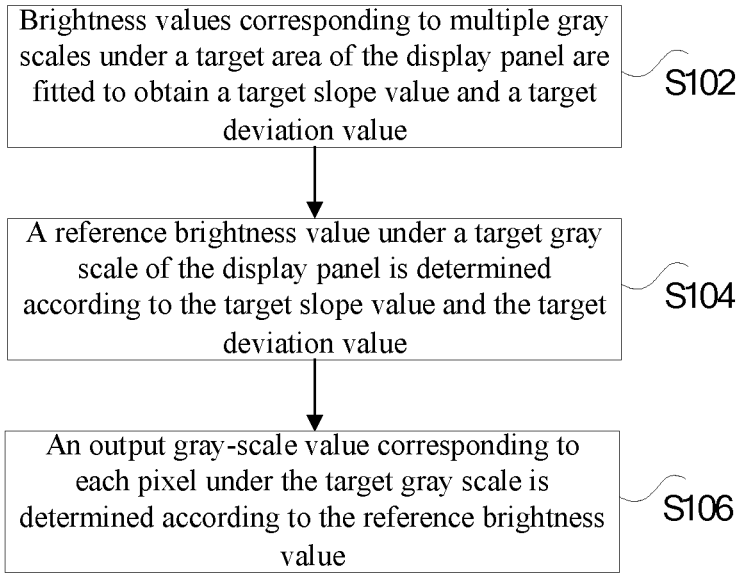
FIG. 1 is a flowchart of a method for determining an output gray-scale value of a display panel according to an embodiment of the present disclosure.

In order to make those skilled in the art understand the solutions of the present disclosure better, the technical solutions in the embodiments of the present disclosure are clearly and completely elaborated below in combination with the accompanying drawings. It is apparent that the described embodiments are only a part of the embodiments of the present disclosure but not all. Based on the embodiments of the present disclosure, all the other embodiments obtained by those of ordinary skill in the art on the premise of not contributing creative effort should belong to the protection scope of the present disclosure.

It is to be noted that the terms like "first" and "second" in the specification, claims and accompanying drawings of the present disclosure are used for differentiating the similar objects, but do not have to describe a specific order or a sequence. It should be understood that the objects are exchanged under appropriate circumstances, so that the embodiments of the present disclosure described here are implemented in an order different from that described or shown here. In addition, terms "include" and "have" and any variations thereof are intended to cover non-exclusive inclusions. For example, it is not limited for processes, methods, systems, products or devices containing a series of steps or components to clearly list those steps or components, and other steps or components which are not clearly listed or are inherent to these processes, methods, products or devices may be included instead.

To facilitate users' understanding of the present disclosure, a part of terms or nouns involved in each embodiment of the present disclosure are explained below.

Mura refers to a phenomenon of a variety of traces caused by nonuniform brightness of a display.

Demura refers to a technology that eliminates Mura of the display to make screen brightness uniform. In implementation, it is possible to make a panel display a gray-scale image, use various charge coupled devices to capture a screen, obtain a brightness value of each pixel in the panel, and adjust a gray-scale value or voltage of the pixel in a Mura area.

The following embodiments of the present disclosure are applied to various display panels, and there are no specific limits on the types and models of the display panels. The display panels include, but not limited to, an LED display screen, a display screen of PC, a display screen of tablet PC, etc. In each embodiment of the present disclosure, the phenomenon of a variety of defects and traces caused by nonuniform brightness of the display panel are eliminated. In the embodiments of the present disclosure, the gray-scale value of each area is determined according to the brightness value under the gray scale of image, and then brightness adjustment is performed for the area with a large error (for example, the brightness is turned up or turned down), to achieve the purpose of making screen brightness uniform to eliminate Mura. Each embodiment is described in detail below.

Embodiment 1

According to the embodiments of the present disclosure, an embodiment of a method for determining an output gray-scale value of a display panel is provided. It is to be noted that these steps presented in the flowchart of the accompanying drawings can be executed in a computer system like a group of computer executable instructions, and moreover, although a logical sequence is shown in the flowchart, in some cases, the presented or described steps can be performed in a sequence different from that described here.

FIG. 1 is a flowchart of the method for determining an output gray-scale value of a display panel according to an embodiment of the present disclosure. As shown in FIG. 1, the method includes the following steps.

At S102, brightness values corresponding to multiple gray scales under a target area of the display panel are fitted to obtain a target slope value and a target deviation value.

In the present disclosure, the area as a panel brightness reference is the whole display panel, and also is the target area of the display panel. In the present disclosure, a description is given based on the target area of the display panel, and the brightness of the whole display panel is adjusted by taking the average brightness value of the target area as a reference brightness value of the whole display panel. Preferably, the target area of the display panel is a central area of the display panel. Each display panel includes multiple sub-pixels, and each sub-pixel corresponds to a gray-scale value and a brightness value.

Optionally, the multiple gray scales in the present disclosure are preset, for example, six gray scales are selected, which are respectively 8, 16, 32, 64, 128 and 255. The exact number of the multiple gray scales is not limited, for example, the number of the multiple gray scales is 6 or 8.

The step that the brightness values corresponding to the multiple gray scales under the target area of the display panel are fitted to obtain the target slope value and the target deviation value includes that: the brightness value corresponding to each pixel under the multiple gray scales is acquired to obtain the multiple brightness values corresponding to each gray scale; the multiple accumulated brightness values are obtained according to the multiple brightness values corresponding to each gray scale; the average brightness value corresponding to each gray scale is determined according to the multiple accumulated brightness values; and the target slope value and the target deviation value are determined according to the average brightness value corresponding to each gray scale. It is to be noted that the operation that the target slope value and the target deviation value are determined according to the average brightness value corresponding to each gray scale includes that: the multiple gray scales and the average brightness value under each gray scale are fitted to determine a target reference line; and the target slope value and the target deviation value are determined according to the target reference line.

That is, the average brightness value under each gray scale is determined by accumulating the multiple brightness values corresponding to each pixel under each gray scale, and a reference line is obtained by fitting each average brightness value and the gray-scale value corresponding to the gray scale, thus the slope value and the deviation value about the reference line are obtained, and a reference slope value (namely the target slope value) and a reference deviation value (namely the target deviation value) of each pixel in the calculation process are obtained.

Original data is the brightness value of each sub-pixel corresponding to the multiple gray scales, that is, gamma of each sub-pixel is fitted.

At S104, a reference brightness value under a target gray scale of the display panel is determined according to the target slope value and the target deviation value.

That is, the corresponding reference brightness value is obtained after the target slope value and the target deviation value are obtained, wherein the reference brightness value is understood as the average brightness value of the target area. The reference brightness value is taken as the reference brightness value of each pixel so that the brightness value of each pixel can reach the reference brightness value.

The multiple gray scales at least include: the target gray scale (such as gray64) and a maximum gray scale (such as gray255). Before the reference brightness value under the target gray scale of the display panel is determined according to the target slope value and the target deviation value, the method further includes that: an average brightness value corresponding to the maximum gray scale in the multiple gray scales is obtained; according to the average brightness value corresponding to the maximum gray scale, the average brightness value corresponding to the maximum gray scale and each pixel are fitted to determine a slope value and a deviation value corresponding to each pixel; according to the slope value and the deviation value corresponding to each pixel, the gamma of each pixel in the display panel is determined. Optionally, the operation that the average brightness value corresponding to the maximum gray scale and each pixel are fitted to determine the slope value and the deviation value corresponding to each pixel includes that: each of the multiple gray scales and the maximum gray scale are normalized to obtain multiple normalized gray-scale values; the multiple brightness values of each pixel and the average brightness value corresponding to the maximum gray scale are normalized to obtain multiple normalized brightness values; the slope value and the deviation value corresponding to each pixel are determined according to the multiple normalized gray-scale values and the multiple normalized brightness values.

That is, the gamma corresponding to each pixel in the display panel is determined by the above way. The gamma corresponds to the slope value and the deviation value, namely gamma (the slope value, the deviation value). A pixel reference line corresponding to each pixel is obtained by fitting the multiple gray scales corresponding to each pixel and the reference brightness value under each gray scale, and then the gamma corresponding to each pixel is determined according to the pixel reference line. For example, the average brightness value and the maximum pixel brightness corresponding to the gray scale 32 are respectively 10 and 15; the average brightness value and the maximum pixel brightness corresponding to the gray scale 64 are respectively 20 and 25; the average brightness value and the maximum pixel brightness corresponding to the gray scale 128 are respectively 40 and 45; and the average brightness value and the maximum pixel brightness corresponding to the gray scale 255 are respectively 100 and 105. In the present disclosure, the average brightness value corresponding to the maximum gray scale (namely the gray scale 255) is taken as a normalized brightness value. In fitting, each gray-scale value and brightness value are normalized, and for example, the gray scale 32 corresponds to log(32/255), the gray scale 64 corresponds to log(64/255), the gray scale 128 corresponds to log(128/255), and the gray scale 255 corresponds to log(255/255), and the final values can be obtained by querying a preset normalized gray scale table.

Moreover, each brightness value (the maximum brightness value is adopted) is normalized, and for example, under the gray scale 32, the normalized brightness value obtained is log(15/100); under the gray scale 64, the normalized brightness value obtained is log(25/100); under the gray scale 128, the normalized brightness value obtained is log(45/100); and under the gray scale 255, the normalized brightness value obtained is log(105/100). At last, the slope value and the deviation value corresponding to the pixel are determined through a normalized gray-scale value and a normalized brightness value under each gray scale.

Optionally, the operation that the reference brightness value under the target gray scale of the display panel is determined according to the target slope value and the target deviation value includes that: a target gray-scale value corresponding to the target gray scale is determined; a gray-scale ratio is determined according to the target gray-scale value corresponding to the target gray scale and a maximum gray-scale value corresponding to the maximum gray scale; and the reference brightness value under the target gray scale of the display panel is determined according to the normalized gray-scale value and a first formula, wherein the first formula is: $f(ref)=aX+b$, where $x=\log(GRAY/255)$, Gray is the target gray-scale value, a is the target slope value, b is the target deviation value, f(ref) is the reference brightness value, and X is the normalized gray-scale value.

The reference brightness value under the target gray scale is obtained through the above formula.

At S106, an output gray-scale value corresponding to each pixel under the target gray scale is determined according to the reference brightness value.

Optionally, the operation that the output gray-scale value corresponding to each pixel under the target gray scale is determined according to the reference brightness value includes that: the output gray-scale value corresponding to each pixel under the target gray scale is calculated through the reference brightness value and a second formula, wherein the second formula is: $\log(Li/L255)=a*\log(Grayi/255)+b$, where a is the slope value of a target pixel, b is the deviation value of the target pixel, i is the target gray scale, Li is the reference brightness value under the target gray scale, L255 is the average brightness value corresponding to the maximum gray scale, and Grayi is the output gray-scale value corresponding to the target pixel under the target gray scale.

In the above formula, L255 is the average brightness value corresponding to the maximum gray scale, and it serves as the reference brightness value corresponding to each gray scale in the whole display panel. The output gray-scale value corresponding to each pixel is obtained through the second formula, thereby making output brightness of the whole display panel uniform to achieve the effect of eliminating Mura.

Moreover, in the embodiments of the present disclosure, the output gray-scale value also is obtained in another way. The operation that the output gray-scale value corresponding to each pixel under the target gray scale according to the reference brightness value further includes that: the target gray scale and the maximum gray scale are normalized through the reference brightness value, and a preset normalized gray scale table is queried to obtain a target normalized gray-scale value; the multiple normalized gray-scale values corresponding to the multiple adjacent gray scales of the target gray scale are queried in the preset normalized gray scale table; and the multiple normalized brightness values corresponding to the multiple gray scales are calculated through the target normalized gray-scale value, the multiple normalized gray-scale values and a third formula, wherein the third formula is: $\log(L/L255)=a*\log(Gray/255)+b$, where a is the target slope value, b is the target deviation value, log(Gray/255) is the normalized gray-scale value, and log(L/L255) is the normalized brightness value; the difference between each of the multiple normalized brightness values and the reference brightness value is acquired to obtain the multiple brightness difference values; the brightness value corresponding to a minimum absolute value in the brightness difference values is queried to obtain a target brightness value; and the output gray-scale value corresponding to the target brightness value is determined.

The number of the above multiple adjacent gray scales is not limited, and for example, the number is 32. Taking the gray scale 64 for example, the normalized brightness value of the gray scale the adjacent gray scale of which is 48-80 is obtained, a difference value between each normalized brightness value and the reference brightness value is queried, and the normalized brightness value corresponding to the minimum absolute value of the difference value is adopted to determine a gray scale area where the reference brightness value is, and the output gray-scale value is obtained through the third formula.

By means of the above steps, it is implemented that the brightness values corresponding to the multiple gray scales under the target area of the display panel are fitted to obtain the target slope value and the target deviation value at first, then the reference brightness value of the display panel at the target pixel is determined according to the target slope value and the target deviation value, and at last, the output gray-scale value corresponding to each pixel under the target gray scale is determined according to the reference brightness value. In the embodiments, the corresponding slope value and deviation value are obtained through the gray-scale values and the brightness values corresponding to the multiple known gray scales, and the output gray-scale value corresponding to each pixel in the display panel is determined according to the obtained reference brightness value and the slope value and the deviation value corresponding to each pixel, thereby making the brightness of the panel uniform to achieve the purpose of effectively eliminating Mura, and furthermore solving the technical problem in the related art of low efficiency caused by a large amount of calculation when the gray-scale value of the display panel is calculated.

In an optional embodiment, after the output gray-scale value corresponding to each pixel under the target gray scale is determined according to the reference brightness value, the method further includes that: according to the distribution of pixels of the display panel, the slope values and the deviation values corresponding to the multiple pixels under each gray scale are partitioned, and a data area with a preset width and a preset length is determined, wherein the data area includes multiple data blocks, and the gray-scale values are stored in each data block; data in the data block at a target position in the data area is determined as reference data; an index difference value between every two adjacent data blocks is determined according to a preset index mode; index values corresponding to other data blocks except the data block at the target position are determined according to the index difference value.

It is to be noted that after the index values corresponding to other data blocks except the data block at the target position are determined, the method further includes that the reference data corresponding to the data block at the target position in the data area and the index values corresponding to other data blocks except the data block at the target position are stored respectively.

Through the above embodiments, the data are effectively stored. The target position is preset, and includes, but not limited to, the first row and the first column in the data area, the center of the data area, and so on. In the above embodiments of the present disclosure, taking a Mura area concentration characteristic for example, during storage, the original data is divided into the data blocks to perform quantized storage; that is, the value of the target position in the data area is taken as an original value, and the other positions store index values of the difference values from the original value. Table 1 is taken as an example.

TABLE 1

| | | | |
|---|---|---|---|
| 11 | 12 | 13 | 14 |
| 21 | 22 | 23 | 24 |
| 31 | 32 | 33 | 34 |
| 41 | 42 | 43 | 44 |

In Table 1, there are 4 rows and 4 columns. The numbers in the table represent storage locations, and for example, 11 represents the first row and the first column, and 14 represents the first row and the fourth column. When data is stored, the data block at 11 (namely the grid at 11) is selected to store the data, and other data blocks (namely the grids corresponding to other numbers) store the index values of the difference values from the original data represented by the data block 11. For example, if the a stored in the data block 11 is 10, the a stored in the data block 12 is 12, and the a stored in the data block 13 is 14, then during storage, the a is directly stored in the data block 11 and is 10, the data block 12 stores 01, and the data block 13 stores 02. Wherein, in the present disclosure, it is set that 00 is the same as the original data, the difference between 01 and the original data is 2 bits, and the difference between 02 and the original data is 4 bits. In this way, it is possible to only store one original data, and store the index values of the difference values from the original data at other positions, which greatly reduces storage content. For example, the original data is 8 bits, and the index value is 2 bits, if the original data is stored, 8*16, namely 96 bits are needed; but in the present disclosure, only 8+15*2, namely 38 bits are needed. By comparison, the storage way in the present disclosure greatly reduces storage space and storage pressure.

In another optional embodiment, when an input gray-scale ratio is not a fixed gray-scale ratio, a compensation value of the gray scale is obtained by means of a linear difference method.

Embodiment 2

Figure 2:
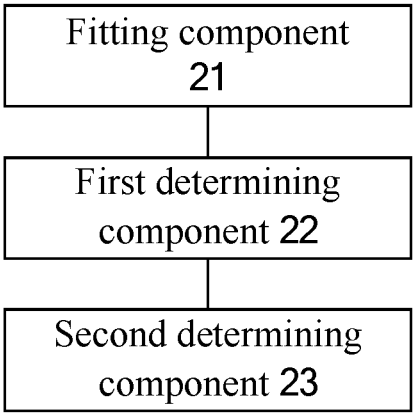
FIG. 2 is a schematic diagram of a device for determining an output gray-scale value of a display panel according to an embodiment of the present disclosure.

FIG. 2 is a schematic diagram of a device for determining an output gray-scale value of a display panel. As shown in FIG. 2, the device includes: a fitting component 21, configured to fit brightness values corresponding to multiple gray scales under a target area of the display panel to obtain a target slope value and a target deviation value; a first determining component 22, configured to determine, according to the target slope value and the target deviation value, a reference brightness value under the target gray scale of the display panel; and a second determining component 23, configured to determine, according to the reference brightness value, an output gray-scale value corresponding to each pixel under the target gray scale.

By means of the above device, it is possible to use the fitting component 21 to fit the brightness values corresponding to the multiple gray scales under the target area of the display panel to obtain the target slope value and the target deviation value at first, then determine, through the first determining component 22, the reference brightness value of the display panel at the target pixel according to the target slope value and the target deviation value, and at last, determine, through the second determining component 23, the output gray-scale value corresponding to each pixel under the target gray scale according to the reference brightness value. In the embodiments, the corresponding slope value and deviation value are obtained through the gray-scale values and the brightness values corresponding to the multiple known gray scales, and the output gray-scale value corresponding to each pixel in the display panel is determined according to the obtained reference brightness value and the slope value and the deviation value corresponding to each pixel, thereby making the brightness of the panel uniform to achieve the purpose of effectively eliminating Mura, and furthermore solving the technical problem in the related art of low efficiency caused by a large amount of calculation when the gray-scale value of the display panel is calculated.

Optionally, the fitting component 21 includes: a first acquiring element, configured to acquire the brightness value corresponding to each pixel under the multiple gray scales to obtain multiple brightness values corresponding to each gray scale; an accumulating element, configured to obtain multiple accumulated brightness values according to the multiple brightness values corresponding to each gray scale; a first determining element, configured to determine the average brightness value corresponding to each gray scale according to the multiple accumulated brightness values; and a second determining element, configured to determine the target slope value and the target deviation value according to the average brightness value corresponding to each gray scale.

The second determining element includes: a first determining subelement, configured to fit the multiple gray scales and the brightness value under each gray scale to determine a target reference line; and a second determining subelement, configured to determine the target slope value and the target deviation value according to the target reference line.

It is to be noted that the multiple gray scales at least include: the target gray scale and the. The device further includes: a second acquiring element, configured to acquire, before determining the reference brightness value under the target gray scale of the display panel according to the target slope value and the target deviation value, an average brightness value corresponding to the maximum gray scale in the multiple gray scales; a fitting element, configured to fit, according to the average brightness value corresponding to the maximum gray scale, the average brightness value corresponding to the maximum gray scale and each pixel to determine a slope value and a deviation value corresponding to each pixel; and a third determining element, configured to determine, according to the slope value and the deviation value corresponding to each pixel, gamma of each pixel in the display panel.

Optionally, the fitting element includes: a first normalizing element, configured to normalize each of the multiple gray scales and the maximum gray scale to obtain multiple normalized gray-scale values; a second normalizing element, configured to normalize the multiple brightness values of each pixel and the average brightness value corresponding to the maximum gray scale to obtain multiple normalized brightness values; and a fourth determining element, configured to determine the slope value and the deviation value corresponding to each pixel according to the multiple normalized gray-scale values and the multiple normalized brightness values.

The first determining component includes: a first determining subelement, configured to determine a target gray-scale value corresponding to the target gray scale; a second determining subelement, configured to determine a gray-scale ratio according to the target gray-scale value corresponding to the target gray scale and a maximum gray-scale value corresponding to the maximum gray scale, and determine the reference brightness value under the target gray scale of the display panel according to the normalized gray-scale value and a first formula, wherein the first formula is: $f(ref)=aX+b$, where $X=\log(GRAY/255)$, GRAY is the target gray-scale value, a is the target slope value, b is the target deviation value, f(ref) is the reference brightness value, and X is the normalized gray-scale value.

Optionally, the second determining component 25 includes: a calculating element, configured to calculate the output gray-scale value corresponding to each pixel under the target gray scale through the reference brightness value and a second formula, wherein the second formula is: $\log(Li/L255)=a*\log(Grayi/255)+b$, where a is the slope value of the target pixel, b is the deviation value of the target pixel, i is the target gray scale, Li is the reference brightness value under the target gray scale, L255 is the average brightness value corresponding to the maximum gray scale, and Grayi is the output gray-scale value corresponding to the target pixel under the target gray scale.

The multiple gray scales at least include the target gray scale and the maximum gray scale. The second determining component further includes: a third normalizing element, configured to normalize the target gray scale and the maximum gray scale through the reference brightness value, and query a preset normalized gray scale table to obtain a target normalized gray-scale value; a first querying element, configured to query the multiple normalized gray-scale values corresponding to the multiple adjacent gray scales of the target gray scale in the preset normalized gray scale table; and a calculating subelement, configured to calculate the multiple normalized brightness values corresponding to the multiple gray scales through the target normalized gray-scale value, the multiple normalized gray-scale values and a third formula, wherein the third formula is: $\log(L/L255)=a*\log(Gray/255)+b$, where a is the target slope value, b is the target deviation value, $\log(Gray/255)$ is the normalized gray-scale value, and $\log(L/L255)$ is the normalized brightness value; a comparing element, configured to acquire the difference between each of the multiple normalized brightness values and the reference brightness value to obtain multiple brightness difference values; a second querying element, configured to query the brightness value corresponding to a minimum absolute value in the brightness difference values to obtain a target brightness value; and a fifth determining element, configured to determine the output gray-scale value corresponding to the target brightness value.

It is to be noted that the device further includes: a third determining component, configured to partition, after determining the output gray-scale value corresponding to each pixel under the target gray scale according to the reference brightness value, the slope values and the deviation values corresponding to the multiple pixels under each gray scale according to the distribution of pixels of the display panel, and determine a data area with a preset width and a preset length, wherein the data area includes the multiple data blocks, and the gray-scale values are stored in each data block; a fourth determining component, configured to determine data in the data block at a target position in the data area as the reference data; a fifth determining component, configured to determine an index difference value between every two adjacent data blocks according to a preset index mode; and a sixth determining component, configured to determine index values corresponding to other data blocks except the data block at the target position according to the index difference value.

In another optional embodiment, the device further includes: a storing component, configured to respectively store, after determining the index values corresponding to other data blocks except the data block at the target position, the reference data corresponding to the data block at the target position in the data area and the index values corresponding to other data blocks except the data block at the target position.

According to another aspect of the embodiments of the present disclosure, a computer readable storage medium is also provided, which is configured to store a program. When executed by a processor, the program controls a device where the computer readable storage medium is to execute the above method for determining an output gray-scale value of a display panel.

According to another aspect of the embodiments of the present disclosure, a processor is also provided, which is configured to run a program. When running, the program executes the above method for determining an output gray-scale value of a display panel.

The device for determining an output gray-scale value of a display panel further includes a processor and a memory. The fitting component 21, the first determining component 22, the second determining component 23, etc. are stored in the memory as program components, and the processor executes these program components stored in the memory to implement corresponding functions.

The processor includes a core, and the core retrieves the corresponding program component from the memory. One or more than one core is set, and the output gray-scale value corresponding to each pixel under the target gray scale is obtained by adjusting parameters of the core.

The memory includes a volatile memory, a Random Access Memory (RAM) and/or a nonvolatile memory, and other forms in computer readable media, for example, a Read Only Memory (ROM) or a flash RAM. The memory includes at least one memory chip.

The embodiments of the present disclosure provide a device, which includes: a processor, a memory and a program stored on the memory and able to run on the program. When executing the program, the processor implements the following steps: the brightness values corresponding to the multiple gray scales under the target area of the display panel are fitted to obtain the target slope value and the target deviation value; the reference brightness value corresponding to the target pixel of the display panel is determined according to the target slope value and the target deviation value; and the output gray-scale value corresponding to each pixel under the target gray scale is determined according to the reference brightness value.

Optionally, when executing the program, the processor may further perform the following operations: the brightness value corresponding to each pixel under the multiple gray scales is acquired to obtain the multiple brightness values corresponding to each gray scale; the multiple brightness values are obtained according to the multiple brightness values corresponding to each gray scale; the brightness value corresponding to each gray scale is determined according to the multiple brightness values; and the target slope value and the target deviation value are determined according to the brightness value corresponding to each gray scale.

Optionally, when executing the program, the processor may further perform the following operations: the average brightness value of each of the multiple reference pixels is determined to obtain the multiple average brightness values; the multiple average brightness values are fitted to determine the target reference line; and the target slope value and the target deviation value are determined according to the target reference line.

Optionally, when executing the program, and before determining the reference brightness value under the target gray scale of the display panel according to the target slope value and the target deviation value, the processor may further perform the following operations: the average brightness value corresponding to the maximum gray scale in the multiple gray scales is obtained; according to the average brightness value corresponding to the maximum gray scale, the average brightness value corresponding to the maximum gray scale and each pixel are fitted to determine the slope value and the deviation value corresponding to each pixel; and according to the slope value and the deviation value corresponding to each pixel, gamma of each pixel in the display panel is determined.

Optionally, when executing the program, the processor may further perform the following operations: each of the multiple gray scales and the maximum gray scale are normalized to obtain the multiple normalized gray-scale values; the multiple brightness values of each pixel and the average brightness value corresponding to the maximum gray scale are normalized to obtain the multiple normalized brightness values; and the slope value and the deviation value corresponding to each pixel are determined according to the multiple normalized gray-scale values and the multiple normalized brightness values.

Optionally, when executing the program, the processor may further perform the following operations: the target gray-scale value corresponding to the target gray scale is determined; the gray-scale ratio is determined according to the target gray-scale value corresponding to the target gray scale and the maximum gray-scale value corresponding to the maximum gray scale, and the reference brightness value under the target gray scale of the display panel is determined according to the normalized gray-scale value and the first formula, wherein the first formula is: $f(ref)=aX+b$, where $x=\log(GRAY/255)$, GRAY is the target gray-scale value, a is the target slope value, b is the target deviation value, f(ref) is the reference brightness value, and X is the normalized gray-scale value.

Optionally, when executing the program, the processor may further calculate the output gray-scale value corresponding to each pixel under the target gray scale through the reference brightness value and the second formula, wherein the second formula is: $\log(Li/L255)=a*\log(Grayi/255)+b$, where a is the slope value of the target pixel, b is the deviation value of the target pixel, i is the target gray scale, Li is the reference brightness value under the target gray scale, L255 is the average brightness value corresponding to the maximum gray scale, and Grayi is the output gray-scale value corresponding to the target pixel under the target gray scale.

Optionally, when executing the program, the processor may further perform the following operations: the target gray scale and the maximum gray scale are normalized through the reference brightness value, and the preset normalized gray scale table is queried to obtain the target normalized gray-scale value; the multiple normalized gray-scale values corresponding to the multiple adjacent gray scales of the target gray scale are queried in the preset normalized gray scale table; and the multiple normalized brightness values corresponding to the multiple gray scales are calculated through the target normalized gray-scale value, the multiple normalized gray-scale values and the third formula, wherein the third formula is: $\log(L/L255)=a*\log(Gray/255)+b$, where a is the target slope value, b is the target deviation value, log(Gray/255) is the normalized gray-scale value, and log(L/L255) is the normalized brightness value; the difference between each of the multiple normalized brightness values and the reference brightness value is acquired to obtain the multiple brightness difference values; the brightness value corresponding to the minimum absolute value in the brightness difference values is queried to obtain the target brightness value; and the output gray-scale value corresponding to the target brightness value is determined.

Optionally, when executing the program, and after determining the output gray-scale value corresponding to each pixel under the target gray scale according to the reference brightness value, the processor may further perform the following operations: the slope values and the deviation values corresponding to the multiple pixels under each gray scale are partitioned according to the distribution of pixels of the display panel, the data area with the preset width and the preset length is determined, wherein the data area includes the multiple data blocks, and the gray-scale values are stored in each data block; data in the data block at the target position in the data area is determined as the reference data; an index difference value between every two adjacent data blocks is determined according to the preset index mode;

and index values corresponding to other data blocks except the data block at the target position are determined according to the index difference value.

Optionally, when executing the program, and after determining the index values corresponding to other data blocks except the data block at the target position, the processor may further perform the following operation: the reference data corresponding to the data block at the target position in the data area and the index values corresponding to other data blocks except the data block at the target position are respectively stored.

The present disclosure also provides a computer program product, which is applied to executing a program initialized with the following steps of method: the brightness values corresponding to the multiple gray scales under the target area of the display panel are fitted to obtain the target slope value and the target deviation value; the reference brightness value of the display panel under the target gray scale is determined according to the target slope value and the target deviation value; and the output gray-scale value corresponding to each pixel under the target gray scale is determined according to the reference brightness value.

The sequence numbers of the embodiments of the present disclosure are just for describing, instead of representing superiority-inferiority of the embodiments.

In the above embodiments of the present disclosure, the descriptions of the embodiments focus on different aspects. A part which is not described in a certain embodiment in detail may refer to the related description of the other embodiments.

In the several embodiments provided in the application, it should be understood that the technical contents disclosed may be realized in other ways. The embodiment of the device described above is only schematic; for example, the division of the components is only a division of logical functions, and there may be other dividing modes during the actual implementation, for example, multiple components or components may be combined or integrated to another system, or some features may be ignored or are not executed. In addition, coupling, direct coupling, or communication connection shown or discussed may be implemented through indirect coupling or communication connection of some interfaces, components or elements, and may be in an electrical form or other forms.

The components described as separate parts may be or may not be separate physically. The part shown as the component may be or may not be a physical component, that is to say, it may be in a place or distributed on multiple network components. Part or all of the components may be selected to achieve the purpose of the solutions of the embodiments according to a practical requirement.

Moreover, all the function components in the embodiments of the present disclosure may be integrated in a processing component; or the components exist separately and physically; or two or more than two components are integrated in a component. The integrated component may be realized in form of hardware or in form of software function component.

If the integrated component is implemented by software function elements, and the software function elements are sold or used as independent products, they can also be stored in a computer readable computer readable storage medium. Based on this understanding, the technical solution of the embodiments of the present disclosure substantially or the part making a contribution to the conventional art can be embodied in the form of software product; the computer software product is stored in a computer readable storage medium, and includes a number of instructions to make a computer device (which may be a personal computer, a server or a network device, etc.) perform all or part of steps of the method in each embodiment of the present disclosure. The storage media include, but not limited to, a USB flash disk, an ROM, an RAM, a mobile hard disk, a magnetic disk, a compact disc, and other media capable of storing the program codes.

The above is only the preferred embodiments of the present disclosure; it should be indicated that, on the premise of not departing from the principles of the present disclosure, those of ordinary skill in the art may also make a number of improvements and supplements, and these improvements and supplements should fall within the protection scope of the present disclosure.

INDUSTRIAL APPLICABILITY

The technical solutions provided by the embodiments of the present disclosure may be used for determining an output gray-scale value of a display panel. In the technical solutions provided by the embodiments of the present disclosure, the corresponding slope value and deviation value may be obtained through the gray-scale values and the brightness values corresponding to the multiple known gray scales, and the output gray-scale value corresponding to each pixel in the display panel may be determined according to the obtained reference brightness value and the slope value and the deviation value corresponding to each pixel, thereby making the brightness of the panel uniform to achieve the purpose of effectively eliminating Mura, and furthermore solving the technical problem in the related art of low efficiency caused by a large amount of calculation when the gray-scale value of the display panel is calculated.

What is claimed is:

1. A method for determining an output gray-scale value of a display panel, comprising:

fitting brightness values corresponding to multiple gray scales under a target area of the display panel to obtain a target slope value and a target deviation value;

according to the target slope value and the target deviation value, determining a reference brightness value under a target gray scale of the display panel; and according to the reference brightness value, determining an output gray-scale value corresponding to each pixel under the target gray scale;

wherein fitting the brightness values corresponding to the multiple gray scales under the target area of the display panel to obtain the target slope value and the target deviation value comprises:

acquiring the brightness value corresponding to each pixel under the multiple gray scales to obtain multiple brightness values corresponding to each gray scale;

obtaining multiple accumulated brightness values according to the multiple brightness values corresponding to each gray scale;

determining the average brightness value corresponding to each gray scale according to the multiple accumulated brightness values; and determining the target slope value and the target deviation value according to the average brightness value corresponding to each gray scale.

2. The method for determining an output gray-scale value as claimed in claim 1, wherein determining the target slope value and the target deviation value according to the average brightness value corresponding to each gray scale comprises:

fitting the multiple gray scales and the average brightness value under each gray scale to determine a target reference line; and determining the target slope value and the target deviation value according to the target reference line.

3. The method for determining an output gray-scale value as claimed in claim 1, wherein the multiple gray scales at least comprise: the target gray scale and a maximum gray scale; before determining the reference brightness value under the target gray scale of the display panel according to the target slope value and the target deviation value, the method further comprises:

acquiring an average brightness value corresponding to the maximum gray scale in the multiple gray scales;

according to the average brightness value corresponding to the maximum gray scale, fitting the average brightness value corresponding to the maximum gray scale and each pixel to determine a slope value and a deviation value corresponding to each pixel; and according to the slope value and the deviation value corresponding to each pixel, determining gamma of each pixel in the display panel.

4. The method for determining an output gray-scale value as claimed in claim 3, wherein fitting the average brightness value corresponding to the maximum gray scale and each pixel to determine the slope value and the deviation value corresponding to each pixel comprises:

normalizing each of the multiple gray scales and the maximum gray scale to obtain multiple normalized gray-scale values;

normalizing the multiple brightness values of each pixel and the average brightness value corresponding to the maximum gray scale to obtain the multiple normalized brightness values; and determining the slope value and the deviation value corresponding to each pixel according to the multiple normalized gray-scale values and the multiple normalized brightness values.

5. The method for determining an output gray-scale value as claimed in claim 4, wherein according to the target slope value and the target deviation value, determining the reference brightness value under the target gray scale of the display panel comprises:

determining a target gray-scale value corresponding to the target gray scale;

determining a gray-scale ratio according to the target gray-scale value corresponding to the target gray scale and a maximum gray-scale value corresponding to the maximum gray scale; and according to the normalized gray-scale value and a first formula, determining the reference brightness value under the target gray scale of the display panel, wherein the first formula is: $f(ref)=aX+b$, where $x=\log(GRAY/255)$, GRAY is the target gray-scale value, a is the target slope value, b is the target deviation value, f(ref) is the reference brightness value, and X is the normalized gray-scale value.

6. The method for determining an output gray-scale value as claimed in claim 5, wherein the multiple gray scales at least comprise: the target gray scale and the maximum gray scale; determining the output gray-scale value corresponding to each pixel under the target gray scale according to the reference brightness value comprises:

calculating the output gray-scale value corresponding to each pixel under the target gray scale through the reference brightness value and a second formula, wherein the second formula is:

$\log(Li/L255)=a*\log(Grayi/255)+b$, where a is the slope value of a target pixel, b is the deviation value of the target pixel, i is the target gray scale, Li is the reference brightness value under the target gray scale, L255 is the average brightness value corresponding to the maximum gray scale, and Grayi is the output gray-scale value corresponding to the target pixel under the target gray scale.

7. The method for determining an output gray-scale value as claimed in claim 5, wherein the multiple gray scales at least comprise: the target gray scale and the maximum gray scale; determining the output gray-scale value corresponding to each pixel under the target gray scale according to the reference brightness value further comprises:

normalizing the target gray scale and the maximum gray scale through the reference brightness value, and inquiring in a preset normalized gray scale table to obtain a target normalized gray-scale value;

querying the multiple normalized gray-scale values corresponding to the multiple adjacent gray scales of the target gray scale in the preset normalized gray scale table;

calculating the multiple normalized brightness values corresponding to the multiple gray scales through the target normalized gray-scale value, the multiple normalized gray-scale values and a third formula, wherein the third formula is $\log(L/L255)=a*\log(Gray/255)+b$, where a is the target slope value, b is the target deviation value, $\log(Gray/255)$ is the normalized gray-scale value, and $\log(L/L255)$ is the normalized brightness value;

acquiring the difference between each of the multiple normalized brightness values and the reference brightness value to obtain multiple brightness difference values;

querying the brightness value corresponding to a minimum absolute value in the brightness difference values to obtain a target brightness value; and determining the output gray-scale value corresponding to the target brightness value.

8. The method for determining an output gray-scale value as claimed in claim 1, wherein after determining the output gray-scale value corresponding to each pixel under the target gray scale according to the reference brightness value, the method further comprises:

according to the distribution of pixels of the display panel, partitioning slope values and deviation values corresponding to the multiple pixels under each gray scale, and determining a data area with a preset width and a preset length, wherein the data area comprises multiple data blocks, and there are the gray-scale values stored in each data block;

determining data in the data block at a target position in the data area as reference data;

determining an index difference value between every two adjacent data blocks according to a preset index mode; and according to the index difference value, determining index values corresponding to other data blocks except the data block at the target position.

9. The method for determining an output gray-scale value as claimed in claim 8, wherein after determining the index values corresponding to other data blocks except the data block at the target position, the method further comprises:

respectively storing the reference data corresponding to the data block at the target position in the data area and the index values corresponding to other data blocks except the data block at the target position.

10. A non-transitory computer readable storage medium, configured to store a program, wherein when executed by a processor, the program controls a device where the non-transitory computer readable storage medium is to execute a method for determining an output gray-scale value of a display panel as claimed in claim 1.

11. A processor, configured to run a program, wherein when running, the program executes a method for determining an output gray-scale value of a display panel as claimed in claim 1.

12. A device for determining an output gray-scale value of a display panel, comprises a hardware processor configured to execute program modules stored on a memory, the program modules comprising:

a fitting component, configured to fit brightness values corresponding to multiple gray scales under a target area of the display panel to obtain a target slope value and a target deviation value;

a first determining component, configured to determine, according to the target slope value and the target deviation value, a reference brightness value corresponding to a target pixel of the display panel; and a second determining component, configured to determine, according to the reference brightness value, an output gray-scale value corresponding to each pixel under the target gray scale; the fitting component comprises:

a first acquiring element, configured to acquire the brightness value corresponding to each pixel under the multiple gray scales to obtain multiple brightness values corresponding to each gray scale;

an accumulating element, configured to obtain multiple accumulated brightness values according to the multiple brightness values corresponding to each gray scale;

a first determining element, configured to determine a average brightness value corresponding to each gray scale according to the multiple accumulated brightness values; and a second determining element, configured to determine the target slope value and the target deviation value according to the average brightness value corresponding to each gray scale.

13. The device for determining an output gray-scale value as claimed in claim 12, wherein the second determining element comprises:

fitting the multiple gray scales and the average brightness value under each gray scale to determine a target reference line; and determining the target slope value and the target deviation value according to the target reference line.

14. The device for determining an output gray-scale value as claimed in claim 12, wherein the multiple gray scales at least comprise: a target gray scale and a maximum gray scale; the device further comprises:

a second acquiring element, configured to acquire, before determining the reference brightness value under the target gray scale of the display panel according to the target slope value and the target deviation value, an average brightness value corresponding to the maximum gray scale in the multiple gray scales;

a fitting element, configured to fit, according to the average brightness value corresponding to the maximum gray scale, the average brightness value corresponding to the maximum gray scale and each pixel to determine a slope value and a deviation value corresponding to each pixel; and a third determining element, configured to determine, according to the slope value and the deviation value corresponding to each pixel, gamma of each pixel in the display panel.

15. The device for determining an output gray-scale value as claimed in claim 14, wherein the fitting element comprises:

a first normalizing element, configured to normalize each of the multiple gray scales and the maximum gray scale to obtain multiple normalized gray-scale values;

a second normalizing element, configured to normalize the multiple brightness values of each pixel and the average brightness value corresponding to the maximum gray scale to obtain multiple normalized brightness values; and a fourth determining element, configured to determine the slope value and the deviation value corresponding to each pixel according to the multiple normalized gray-scale values and the multiple normalized brightness values.

16. The device for determining an output gray-scale value as claimed in claim 15, wherein the first determining component comprises:

a first determining subelement, configured to determine a target gray-scale value corresponding to the target gray scale;

a second determining subelement, configured to determine an output gray-scale ratio according to the target gray-scale value corresponding to the target gray scale and a maximum gray-scale value corresponding to the maximum gray scale, and determine the reference brightness value under the target gray scale of the display panel according to the normalized gray-scale value and a first formula, wherein the first formula is: $f(ref)=aX+b$, where $x=\log(GRAY/255)$, GRAY is the target gray-scale value, a is the target slope value, b is the target deviation value, and f(ref) is the reference brightness value.

17. The device for determining an output gray-scale value as claimed in claim 16, wherein the second determining component comprises:

a calculating element, configured to calculate the output gray-scale value corresponding to each pixel under the target gray scale through the reference brightness value and a second formula, wherein the second formula is: $\log(Li/L255)=a*\log(Grayi/255)+b$, where a is the slope value of the target pixel under the target gray scale, b is the deviation value of the target pixel under the target gray scale, i is the target gray scale, Li is the reference brightness value under the target gray scale, L255 is the average brightness value corresponding to the maximum gray scale, and Grayi is the output gray-scale value corresponding to the target pixel under the target gray scale.

18. The device for determining an output gray-scale value as claimed in claim 16, wherein the multiple gray scales at least comprise: the target gray scale and the maximum gray scale; the second determining component comprises:

a third normalizing element, configured to normalize the target gray scale and the maximum gray scale through the reference brightness value, and query a preset normalized gray scale table to obtain a target normalized gray-scale value;

a first querying element, configured to query the multiple normalized gray-scale values corresponding to the multiple adjacent gray scales of the target gray scale in the preset normalized gray scale table; and a calculating subelement, configured to calculate the multiple normalized brightness values corresponding to the multiple gray scales through the target normalized gray-scale value, the multiple normalized gray-scale values and a third formula, wherein the third formula is: $\log(L/L255)=a*\log(Gray/255)+b$, where a is the target slope value, b is the target deviation value, $\log(Gray/255)$ is the normalized gray-scale value, and $\log(L/L255)$ is the normalized brightness value;

a comparing element, configured to acquire the difference between each of the multiple normalized brightness values and the reference brightness value to obtain multiple brightness difference values;

a second querying element, configured to query the brightness value corresponding to a minimum absolute value in the brightness difference values to obtain a target brightness value; and a fifth determining element, configured to determine the output gray-scale value corresponding to the target brightness value.

* * * * *